US005398524A

United States Patent [19]

Rochez

[11] Patent Number: 5,398,524

[45] Date of Patent: Mar. 21, 1995

[54] PERSONAL PROTECTION RING

[76] Inventor: Leo H. Rochez, 1112 Olympic Heights Dr., Pittsburgh, Pa. 15235

[21] Appl. No.: 249,726

[22] Filed: May 26, 1994

[51] Int. Cl.[6] ..... A44C 9/00

[52] U.S. Cl. ..... 63/15; 63/2

[58] Field of Search ..... 63/1.1, 15, 21, 22, 63/2

[56] References Cited

U.S. PATENT DOCUMENTS

| | | | |
|---|---|---|---|
| 311,429 | 1/1885 | Hoagland | 63/22 |
| D. 326,241 | 5/1992 | Kroh | 63/1.1 |
| 1,028,667 | 6/1912 | Billau . | |
| 1,269,491 | 6/1918 | Murray | 63/1.1 |
| 1,286,610 | 12/1918 | Harriman | 63/15 |
| 1,432,316 | 10/1922 | Binkis . | |
| 2,441,947 | 5/1948 | Welch | 63/15 |
| 2,453,190 | 11/1948 | Boscowitz | 63/1.1 |
| 3,648,371 | 3/1972 | Petrosky . | |
| 3,995,447 | 12/1976 | Levsunov . | |
| 4,034,982 | 7/1977 | Rupprecht et al. | 63/1.1 |
| 4,135,645 | 1/1979 | Kimmell . | |
| 5,058,278 | 10/1991 | Colvin . | |
| 5,166,823 | 11/1992 | Feinbloom et al. | 63/1.1 |

FOREIGN PATENT DOCUMENTS

| | | | |
|---|---|---|---|
| 783480 | 7/1935 | France | 63/1.1 |
| 15008 | of 1886 | United Kingdom | 63/21 |
| 280147 | 11/1927 | United Kingdom . | |

*Primary Examiner*—Michael J. Milano
*Attorney, Agent, or Firm*—Bacon & Thomas

[57] ABSTRACT

A ring has secured on an upper portion thereof an elongated tubular member. A pin is slidably mounted within the tubular member so as to be selectively shifted between a retracted position wherein the pin is located entirely within the tubular member and an extended position wherein the pin projects from the tubular member and can be used for defensive purposes. A latching arrangement is provided to retain the pin member in at least its extended position. In the preferred embodiment, the pin member is also rotatable within the tubular member and the latching arrangement includes a longitudinal slot formed in the tubular member, along with a pillar which is carried by the pin member and projects through the slot. At least one end of the slot is formed with a notch into which the pillar can be positioned to prevent undesired relative movement between the pin and tubular members.

14 Claims, 1 Drawing Sheet

PERSONAL PROTECTION RING

BACKGROUND OF THE INVENTION

1. Field of the Invention

The present invention pertains to a personal protection device and, more particularly to a ring that is adapted to be worn on a finger and incorporates a pin which can be selectively shifted between a retracted position wherein the pin in located within a housing and an extended position wherein the pin can be used for defensive purposes.

2. Discussion of the Prior Art

Personal safety and protection is increasingly becoming a main concern for many people. For this reason, many different types of portable protection devices are now readily available in today's marketplace and it is not uncommon to find many people, particularly women, carrying such personal protection devices. Often, these known types of personal protection devices are kept in a pocket, purse or bag and removed when needed. Unfortunately, under various circumstances, time does not always permit these devices to be accessed.

This problem has been recognized in the art and therefore various personal protection devices have been proposed which are more readily accessible. For example, it has heretobefore been proposed to construct jewelry, such as rings and bracelets, with some type of personal protection feature. However, mainly due to their particular constructions, these known arrangements have not been favorably viewed.

Therefore, there exists a need in the art for a personal protection device that can be carried or worn in a readily accessible manner and which is not only constructed so as to be generally cosmetically appealing, but constitutes an effective weapon.

SUMMARY OF THE INVENTION

It is the main object of this invention to provide a device that can be utilized for personal protection purposes and which can be worn by a user thereof in a readily accessible and cosmetically appealing manner.

This and other objects of the invention are achieved by providing a ring, adapted to be worn on a finger, including an outer surface portion to which is secured a tubular member that constitutes a mounting support for a gem or the like. A pin is slidably mounted within the tubular member so as to be selectively shifted between a retracted position wherein the pin is located within the tubular member and an extended position wherein the pin projects from the tubular member. When in the extended position, the pin can be used as a weapon for defensive purposes.

The personal protection device in accordance with the present invention is further provided with a latching arrangement for retaining the pin in at least its extended position. In the preferred embodiment, the latching arrangement is partially defined by a transversely extending notch provided at one end of a longitudinally extending slot formed in the tubular member. An upstanding pillar member is secured to the pin and projects through the slot. The pillar member preferably terminates in a mounting element for attaching a gem or the like to the ring. The pillar member is also used to shift the pin relative to the tubular member and, when the pin assumes its fully extended position, the pin can be rotated in order to position the pillar member within the notch. With this arrangement, the pin is prevented from retracting within the tubular member until the pin is again rotated to remove the pillar member from the notch.

Additional objects, features and advantages of the present invention will become more readily apparent from the following detailed description of a preferred embodiment thereof when taken in conjunction with the drawings wherein like reference numerals refer to corresponding parts in the several views.

DETAILED DESCRIPTION OF THE PREFERRED EMBODIMENT

Figure 1:
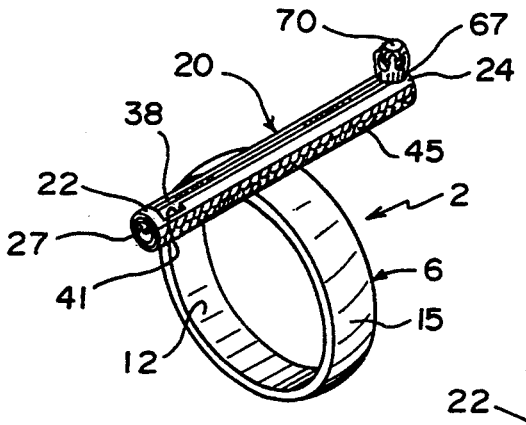
FIG. 1 is a perspective view of the personal protection device of the invention with the pin member in a fully retracted position.

As represented in FIGS. 1–4, the personal protection device of the present invention is generally indicated at 2. Personal protection device is defined by a ring member 6 in the form of an annular band having a central aperture 12 and an outer surface 15. Ring member 6 is adapted to be worn about a finger inserted through central aperture 12. Personal protection device 2 further includes and elongated tubular member 20 having a first end 22 and a second end 24. First end 22 is formed with an opening 27 that leads to an elongated internal cavity 31 defined within tubular member 20. Second end 24 of tubular member 20 is preferably closed by means of a terminal wall 34.

Figure 2:
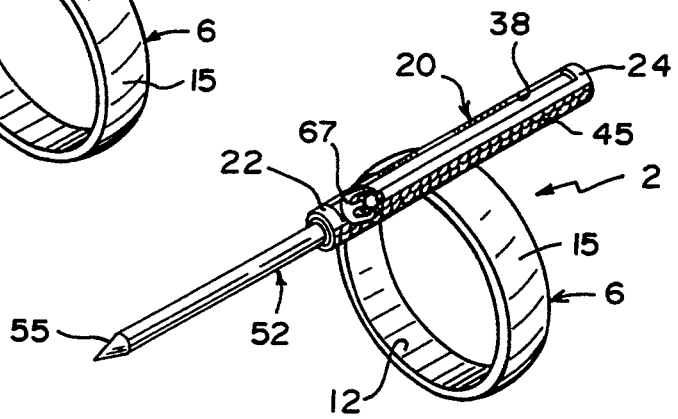
FIG. 2 is a perspective view of the personal protection device of the invention with the pin member in a fully extended and latched position.

Tubular member 20 is formed with an elongated slot 38 that extends through outer surface 15 and opens into internal cavity 31 between first and second ends 22 and 24. Slot 38 is formed with a notch 41 (see FIG. 1), adjacent first end 22, that extends substantially transverse to the longitudinal direction of slot 38. For cosmetic purposes, a chain section 45 can be secured to tubular member 20 on either side of slot 38 as best shown in FIGS. 1 and 2.

Figure 4:
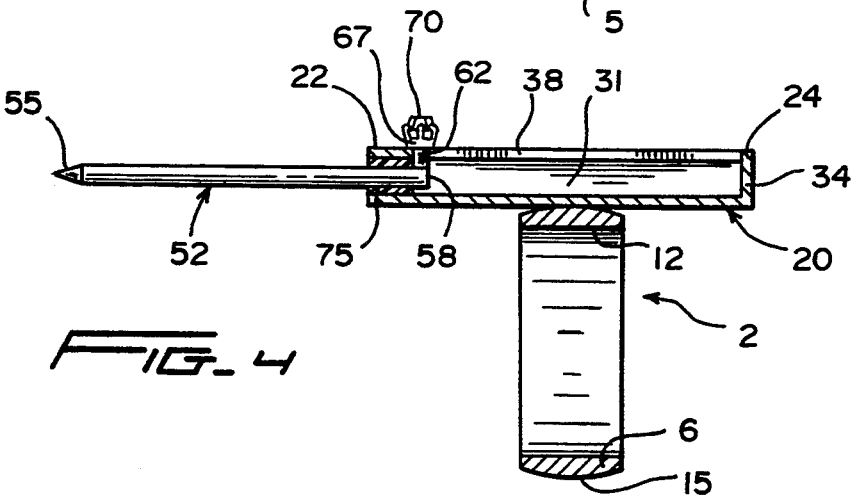
FIG. 4 is a cross-sectional side view similar to that of FIG. 3 but depicting the pin member in its fully extended position.

Slidably mounted within tubular member 20 is a pin member 52 having a pointed end 55 and a squared-off end 58 (see FIG. 4). In the preferred embodiment, tubular member 20 is cylindrical and pin member 52 has a generally circular cross-section such that pin member 52 can also rotate relative to tubular member 20. Pin member 52 has secured thereto, adjacent squared-off end 58, an upright pillar 62 which projects through slot 38. A mounting piece 67 for a gem 70 or the like is fixedly secured atop pillar 62.

Figure 3:
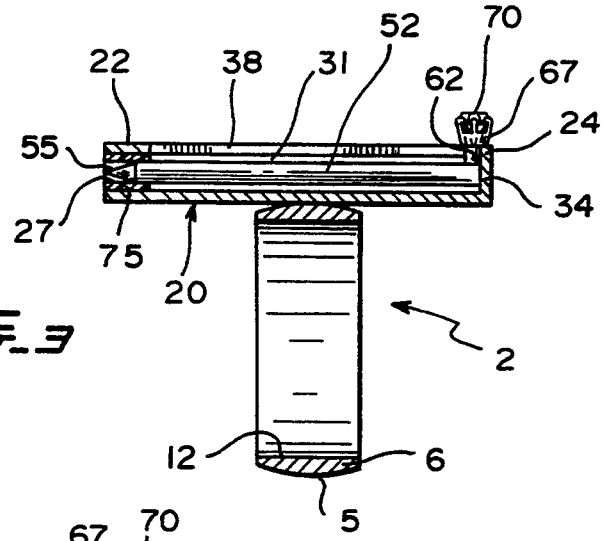
FIG. 3 is a cross-sectional side view of the personal protection device with the pin member in its fully retracted position.

As indicated above, ring member 6 is adapted to be placed about a finger of a user with the finger extending into central aperture 12 from the second end 24 of tubular member 20. When pin member 52 is fully retracted, it will assume the position shown in FIGS. 1 and 3 and ring member 6 may be casually worn. By manually manipulating mounting piece 67, pin member 52 can be shifted longitudinally within internal cavity 31 such that pin member 52 assumes the extended position shown in FIGS. 2 and 4. Once pillar 62 reaches the end of slot 38 adjacent first end 22 of tubular member 20, pin member 52 can be rotated by means of mounting piece 67 such that pillar 62 moves into notch 41 as shown in FIG. 2. In this position, pin member 52 is latched in its fully extended position and can be effectively used for defensive purposes. Pin member 52 will be retained in this extended position until again rotated and shifted relative to tubular member 20 through mounting piece 67 and pillar 62. As best shown in FIG. 3, the fully retracted position of pin member 52 is reached when pillar 62 comes to the end of slot 38. Preferably, this point coincides with the abutment of squared-off end 58 with second end 24 of tubular member 20.

Obviously, the diameter of pin member 52 need only be slightly less than the internal diameter of tubular member 20 in order to permit sliding movement of pin member 52 within internal cavity 31. However, in the preferred embodiment shown, the diameters of tubular member 20 and pin member 52 need not be made with such a small tolerances. Instead, an elastic sleeve 75 is positioned within internal cavity 31 at first end 22. Elastic sleeve 75 is provided with a central bore (not labeled) that is sized so as to be under a slight compression in order that some friction acts between pin member 52 and elastic sleeve 75. This friction functions to prevent undesired relative movement between pin member 52 and tubular member 20 when pin member 52 is fully retracted (see FIG. 3).

Although described with respect to a preferred embodiment of the invention, it should be readily understood that various changes and/or modifications can be made to the invention without departing from the spirit thereof. For example, pillar 62 need not be located at squared-off end 58 but could be located closer to pointed end 55 along pin member 52. In this case, an additional elastic sleeve could be provided at terminal wall 34 within which squared-off end 58 of pin member 52 would extend when pin member 52 is fully retracted. In addition, second end 24 need not be closed off but could include an opening similar to opening 27 in first end 22. Furthermore, various other types of latching or locking arrangements known in the art could be utilized for retaining pin member 52 in its extended and/or retracted positions. Finally, ring member 6 could be modified in numerous ways for aesthetic purposes. In general, the invention is only intended to be limited by the scope of the following claims.

I claim:

1. A personal protection device comprising:

a ring member having a central aperture, said ring member being adapted to be worn by a user of said personal protection device with a finger of the user extending through said central aperture;

an elongated tubular member within which is defined an internal cavity, said elongated tubular member having a first longitudinal end provided with an opening leading into the internal cavity and a second longitudinal end, said tubular member being fixedly secured to and not readily removable from said ring member; and a pin member having a first, pointed end portion and a second end portion, said pin member being slidably mounted within said elongated tubular member between a retracted position wherein said pin member is located within said internal cavity and an extended position wherein the first, pointed end portion thereof projects from said internal cavity.

2. The personal protection device as claimed in claim 1, further comprising means for latching said pin member in said extended position.

3. The personal protection device as claimed in claim 1, further comprising a longitudinally extending slot formed in said elongated tubular member and opening into said internal cavity and a pillar member attached to said pin member and projecting through said slot.

4. The personal protection device as claimed in claim 3, further including a mounting piece secured to an end of said pillar member remote from said pin member.

5. The personal protection device as claimed in claim 3, further comprising means for latching said pin member in said extended position.

6. The personal protection device as claimed in claim 5, wherein said pin member is further rotatably mounted within said tubular member and said latching means comprises a notch extending substantially transversely from said slot, said notch being adapted to receive said pillar member upon rotation of said pin member when said pin member is in said extended position.

7. The personal protection device as claimed in claim 3, further comprising an elastic sleeve, positioned within said tubular member, through which said pin member extends.

8. The personal protection device as claimed in claim 1, wherein the second end of said elongated tubular member is closed by a terminal wall.

9. The personal protection device as claimed in claim 8, wherein the second end portion of said pin member abuts the terminal wall of said elongated tubular member when said pin member is in said retracted position.

10. The personal protection device as claimed in claim 1, further comprising an elastic sleeve, positioned within said tubular member, through which said pin member extends.

11. The personal protection device as claimed in claim 1, wherein the central aperture of said ring member defines a central axis, said tubular member being substantially parallel to said central axis.

12. The personal protection device as claimed in claim 1, wherein said tubular member is fixedly secured to said ring member between said first and second longitudinal ends of said tubular member.

13. The personal protection device as claimed in claim 1, wherein said pin member constitutes an elongated cylindrical member.

14. The personal protection device as claimed in claim 4, further comprising a gem secured in said mounting piece.

* * * * *